US010004967B1

(12) United States Patent
Paulson

(10) Patent No.: US 10,004,967 B1
(45) Date of Patent: Jun. 26, 2018

(54) HINGED BATTING TEE BASE

(71) Applicant: Jugs Sports, Inc., Tualatin, OR (US)

(72) Inventor: Kerry K. Paulson, Tualatin, OR (US)

(73) Assignee: JUGS SPORTS, INC., Tualatin, OR (US)

( * ) Notice: Subject to any disclaimer, the term of this patent is extended or adjusted under 35 U.S.C. 154(b) by 0 days. days.

(21) Appl. No.: 15/389,307

(22) Filed: Dec. 22, 2016

(51) Int. Cl.
*A63B 69/00* (2006.01)
*A63B 71/00* (2006.01)

(52) U.S. Cl.
CPC ..... *A63B 69/0002* (2013.01); *A63B 69/0075* (2013.01); *A63B 69/0091* (2013.01); *A63B 2069/0008* (2013.01); *A63B 2208/0204* (2013.01)

(58) Field of Classification Search
CPC ..... A63B 69/0002; A63B 6/0075; A63B 69/0099
USPC ..... 473/417, 429, 422, 453
See application file for complete search history.

(56) References Cited

U.S. PATENT DOCUMENTS 2,527,906 A * 10/1950 Bennett ..... A63B 69/0075 473/417
3,139,281 A * 6/1964 Nicholson ..... A63B 5/22 473/414
3,425,696 A * 2/1969 Dockum ..... A63F 3/02 473/588
3,450,406 A * 6/1969 Brown ..... A63D 5/00 473/83
4,445,685 A * 5/1984 Cardieri ..... A63B 69/0075 473/417
5,069,460 A * 12/1991 Kulesza ..... A63F 7/06 273/108.22
5,540,430 A * 7/1996 Nichols ..... A63B 69/0002 473/417
7,237,776 B1 * 7/2007 Ngoto ..... A63F 3/02 273/242
D556,834 S * 12/2007 Coleman ..... D21/318
2003/0032506 A1 * 2/2003 Chi ..... A63B 69/0002 473/417
2003/0036446 A1 * 2/2003 Udwin ..... A63B 69/0075 473/417
2011/0183782 A1 * 7/2011 Wang ..... A63B 69/0075 473/417

(Continued)

FOREIGN PATENT DOCUMENTS

FR 2285907 A1 * 4/1976 ..... A63B 67/06

OTHER PUBLICATIONS

Franklin Sports—MLB Fold Away Batting Tee—2015.*

(Continued)

*Primary Examiner* — Mitra Aryanpour
(74) *Attorney, Agent, or Firm* — Schwabe Williamson & Wyatt, PC

(57) ABSTRACT

A base for a batting tee may be provided that includes a first and a second base half that are pivotally mounted to each other such that they can pivot from an open position to one with the two halves flush against one another. The base may also include at least one batting tee mount disposed on at least one of the base halves. Each base half may define an aperture at complementing positions so that a hand hole is defined and extends through each base half for carrying the base when the base halves are flush against each other.

8 Claims, 5 Drawing Sheets

(56) References Cited

U.S. PATENT DOCUMENTS

| | | | | |
|---|---|---|---|---|
| 2011/0190079 | A1* | 8/2011 | Guevara | A63B 69/00 473/417 |
| 2014/0274478 | A1* | 9/2014 | Jorgens | A63B 69/0075 473/417 |
| 2015/0137452 | A1* | 5/2015 | Dahl | A63F 7/0017 273/342 |

OTHER PUBLICATIONS

Jugs Sports, Inc. 5-Point Hitting Tee; retrieved from the Internet at <http://jugssports.com/hitting-tees/5-point-hitting-tee>; retrieved on May 16, 2017; 5 pages.

SKLZ 5-Position Tee—Traditional Batting Trainer; retrieved from the Internet at <https://www.sklz.com/baseball/5-position-tee-v2/BT5P-100-02.html; retrieved on May 16, 2017; 11 pages.

Softball Junk.com Batting Tee LifeLong Hinged Hitting Tee; retrieved from the Internet at <https://softballjunk.com/product/lifelong-hinged-hitting-tee; retrieved on May 16, 2017; 2 pages.

* cited by examiner

HINGED BATTING TEE BASE

FIELD OF THE INVENTION

The invention relates to a base for a batting tee that includes first and second base halves that are pivotally mounted to each other.

BACKGROUND

Batting or hitting tees have been used for many years, not only for younger children who do not yet have the coordination to hit a pitched ball but also for batting drills and to build the hitter's strength up by repeatedly hitting a stationary ball. Many such tees have been sold by Jugs Sports and other companies. Tees typically include a base and tube assemblies, with the tube assemblies having lower ends connected to the base and upper ends designed to hold the ball to be hit at a height approximating that of the player's strike zone. Many batting tees have a single position to which a tee may be mounted. The drawback with single position batting tees is that every time the hitter plans to hit to a different field, such as left or right field, the batter's stance needs to be changed. This renders the practice less realistic and therefore less valuable to the batter since it is difficult or impossible for the batter to change his or her stance as the ball is coming in from the pitcher.

By providing a batting tee that can position a ball at various locations over home plate, the batter can be taught to pull inside pitches and drive outside pitches, providing a more realistic practice experience in that the batter's stance does not need to be changed to hit the ball to different fields. For this reason, suppliers of batting tees have introduced batting tees with three or even five different locations on the plate to which the batting tee may be mounted. One such batting tee has been sold by Jugs Sports.

Providing a batting tee that will permit batters to practice hitting balls on the inside and outside corners, would require the batting tees to be positioned at the very periphery of the plate. This is often not practical so as a result, multiple-position batting tees are often larger that an actual home plate. This results in the batting tee plate being unwieldly to carry, particularly for a child who might be asked to help carry batting practice equipment. Given the required dimensions of a multiple-tee home plate, the plate may even drag on the ground when carrying is attempted, particularly if a child is asked to do so. Multiple-position batting tees are also heavier than a one-position batting tee since the mounting of the tee to the plate needs to be heavy duty and is often fabricated of metal. The weight aspect exacerbates the problem with carrying a multi-position batting tee.

DETAILED DESCRIPTION OF THE PREFERRED EMBODIMENT

Figure 1:
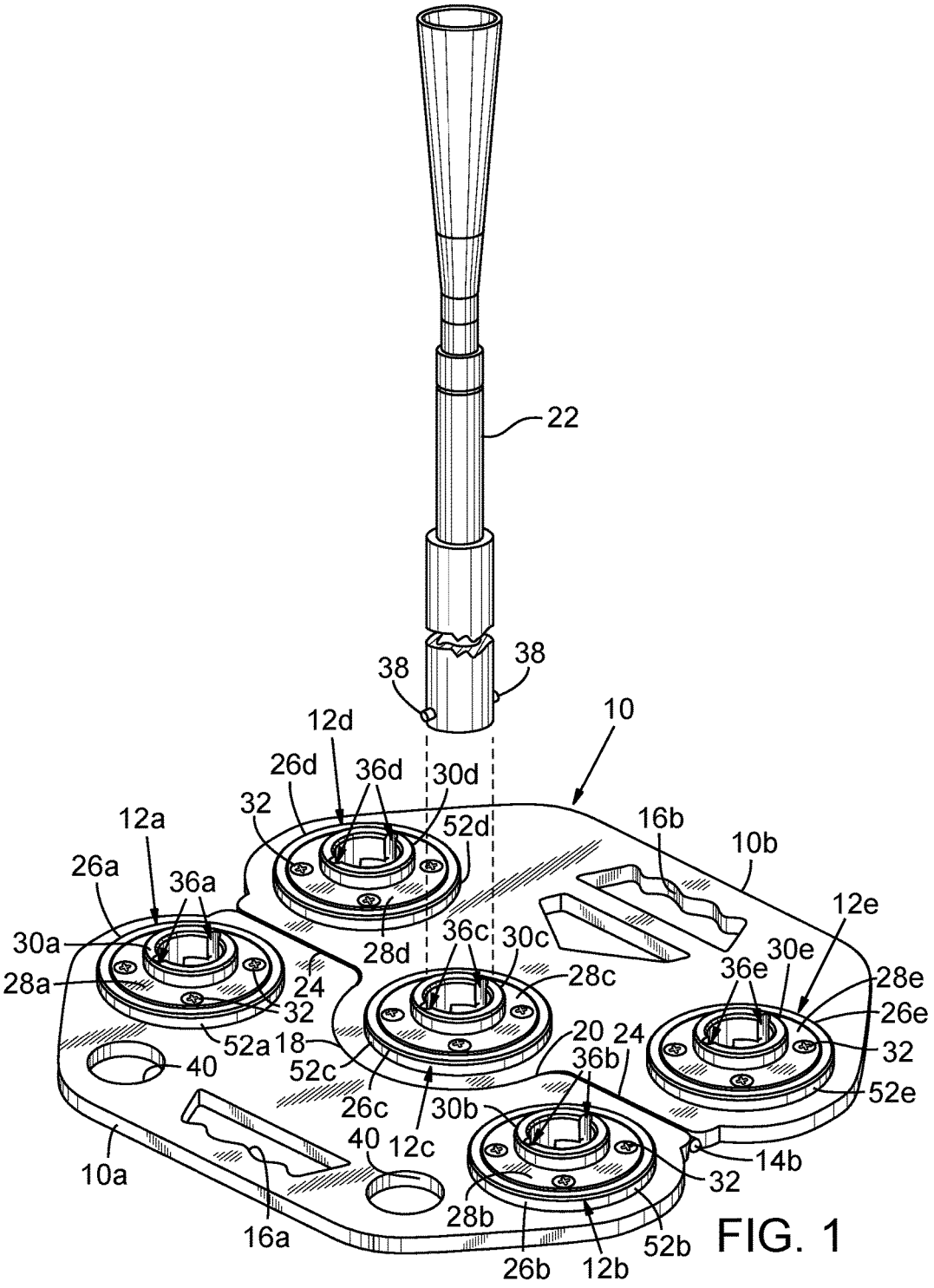
FIG. 1 is a perspective view of a first embodiment of the present disclosure, with two base halves in co-planar disposition, and showing a batting tee mounted to a center tee mount.
Figure 2:
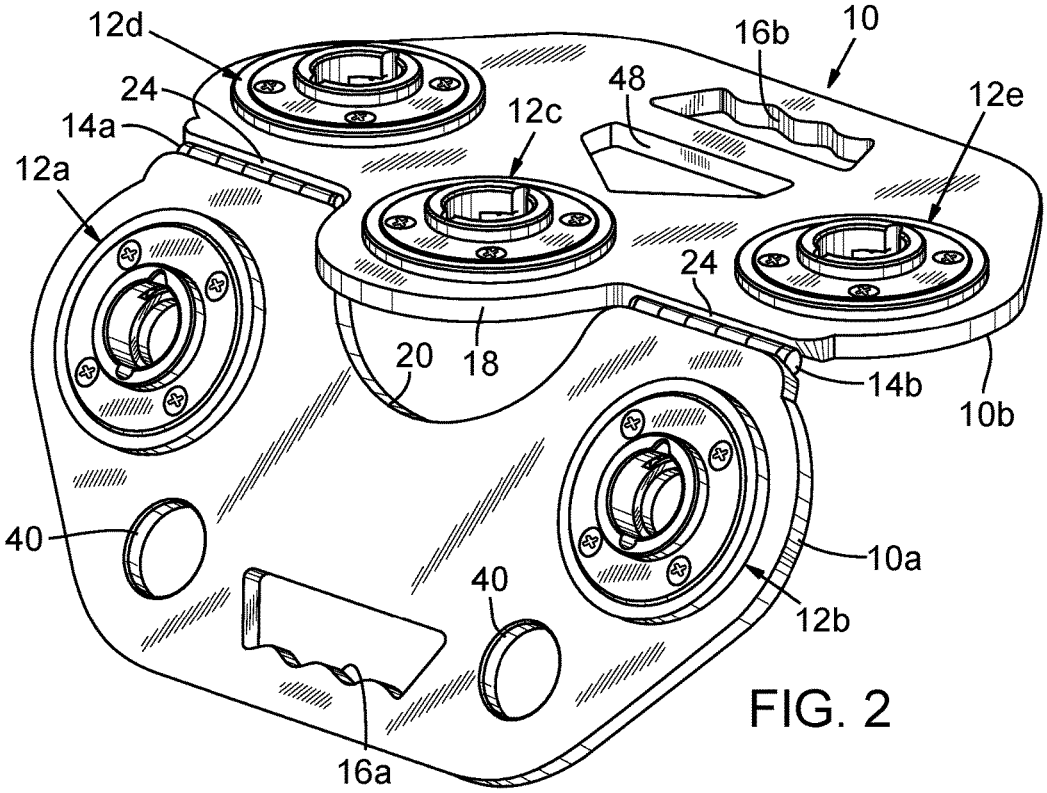
FIG. 2 is a perspective view of the embodiment of FIG. 1, showing the base halves partially pivoted toward a closed position, without the batting tee.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

A base for a batting tee may be provided that includes a first and a second base half that are pivotally mounted to each other such that they can pivot at least from an open position in which the halves are co-planar to one with the two halves flush against one another. The base may also include at least one batting tee mount disposed on at least one of the base halves. Each base half may define an aperture at complementing positions so that a hand hole is defined and extends through each base half for carrying the base when the base halves are flush against each other.

A first embodiment of the base of the batting tee is shown generally at 10, but includes two halves 10*a* and 10*b*. In this discussion, base half 10*a* will sometimes be referred to as the forward half, while base half 10*b* will sometimes be referred to as the rearward half. It should be recognized "halves" is not used in the sense that the two pieces are equal in size, as they may not be and typically are not equal in size.

Batting tee mounts are shown at 12*a*, 12*b*, 12*c*, 12*d* and 12*e*. Five mounts 12*a-e* are included in the depicted embodiment, although it is possible that fewer or more mounts might be included to provide the maximum amount of versatility while being reasonable in size, weight and cost. Batting tee mounts 12*a-e* are shown to be evenly spaced around the two base halves 10*a* and 10*b*. As noted above, there may be fewer or more such mounts but if five mounts are provided, they normally would be positioned generally as depicted, with one mount 12*c* in the center, two of the mounts 12*a* and 12*b* positioned in the forward base half 10*a* adjacent the side edges on the outside and inside, respectively (for the right hand batter), and two of the mounts 12*d* and 12*e* positioned on the rearward base half 10*b* adjacent the side edges on the outside and inside, respectively. If more or fewer mounts are included, they may similarly be positioned in any evenly-spaced array, such as center, forward, rearward, outside or inside.

Figure 5:
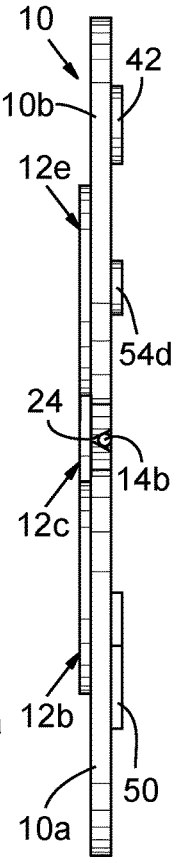
FIG. 5 is a side elevation view of the embodiment of FIG. 1, with the base halves in their co-planar position.
Figure 6:
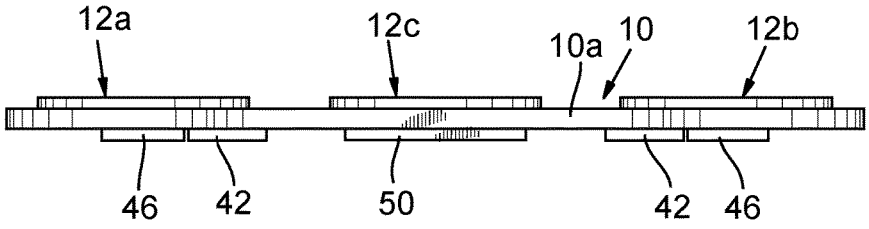
FIG. 6 is an end elevation view of the embodiment of FIG. 1, with the base halves in their co-planar position.

Two halves 10*a* and 10*b* are pivotally mounted to each other such that they may pivot at least between an open position and one in which the two halves are flush against each other. By "at least," it is meant that in some embodiments the two halves may pivot 180 degrees with respect to each other and in other embodiments they may pivot 360 degrees. In the depicted embodiment, the two halves pivot 180 degrees and, as shown best in FIG. 5, the inner edges of halves 10*a* and 10*b* abut each other at 24 to prevent the halves from pivoting more than 180 degrees. This embodiment may therefore facilitate base 10 laying flat on the ground.

Two hinges 14*a* and 14*b* may be provided, connecting the two halves 10*a* and 10*b*, on either side of a central tee mount 12*c*. Hinges 14*a* and *b* are typically coaxial; that is, in alignment along a single axis. It may be that a single continuous hinge is provided in the event there is no tee mount at the center of base 10 or in the event one or more center tee mounts (not shown) are provided forward or rearwardly of the hinge(s). In the depicted base 10, the hinges are shown to be conventional metallic hinges but they may be of any conventional form and configuration, or may just be in the form of flexible plastic portions (which are not depicted) of the base.

If a central tee mount such as that depicted at 10*c* is included, the portion of the base adjacent that mount may extend out toward the other base half, here forward base half 10*a*. In the depicted embodiment, this extension 18 is generally semi-circular in configuration, and a complementing cut-out 20 may be provided in forward base half 10*a*. In the depicted embodiment, the common axis of hinges 14*a* and *b* bisects central tee mount 12*c*.

Figure 3:
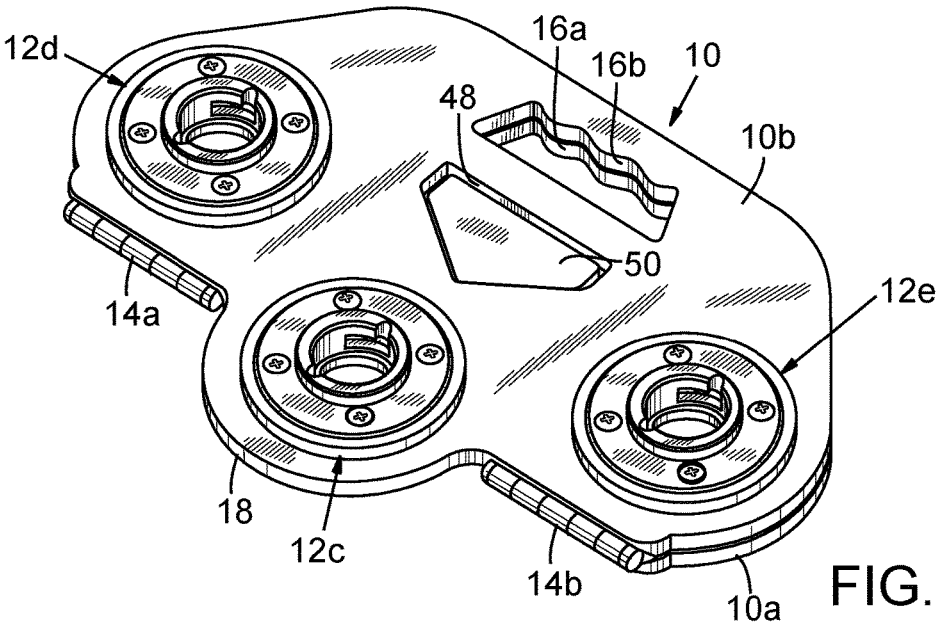
FIG. 3 is a perspective view of the embodiment of FIG. 1, showing the base halves pivoted to closed position, and the hand holes in alignment for carrying, again, without a batting tee.
Figure 4:
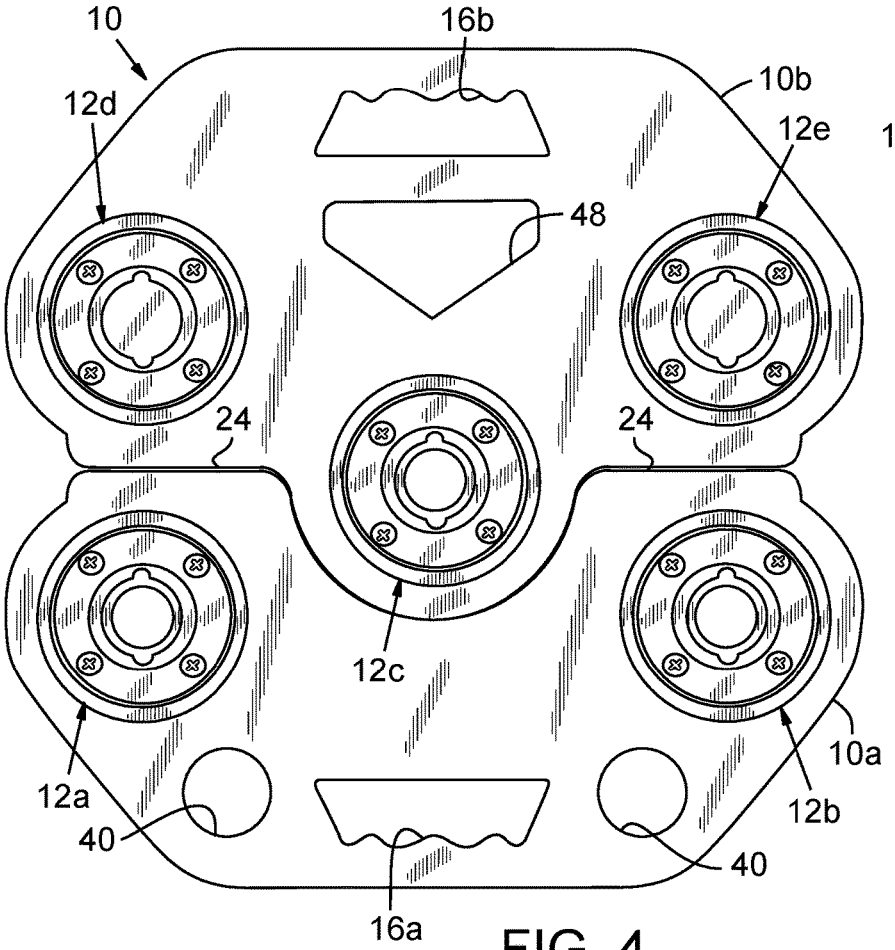
FIG. 4 is a top plan view of the embodiment of FIG. 1, with the base halves in their co-planar position.

A pair of hand apertures or holes 16*a* and 16*b* may be provided in each base half 10*a* and 10*b*, positioned such that when the two base halves 10*a* and 10*b* are pivoted toward each other, they at least partially match up as shown in FIG. 3. Thus, someone asked to carry base 10 can simply fold the two halves against each other and insert a hand through the complementing hand holes 16*a* and 16*b*. This provides a secure hold with a plate dimension that is not much more than half of what it otherwise would be without the hinged aspect.

Figure 7:
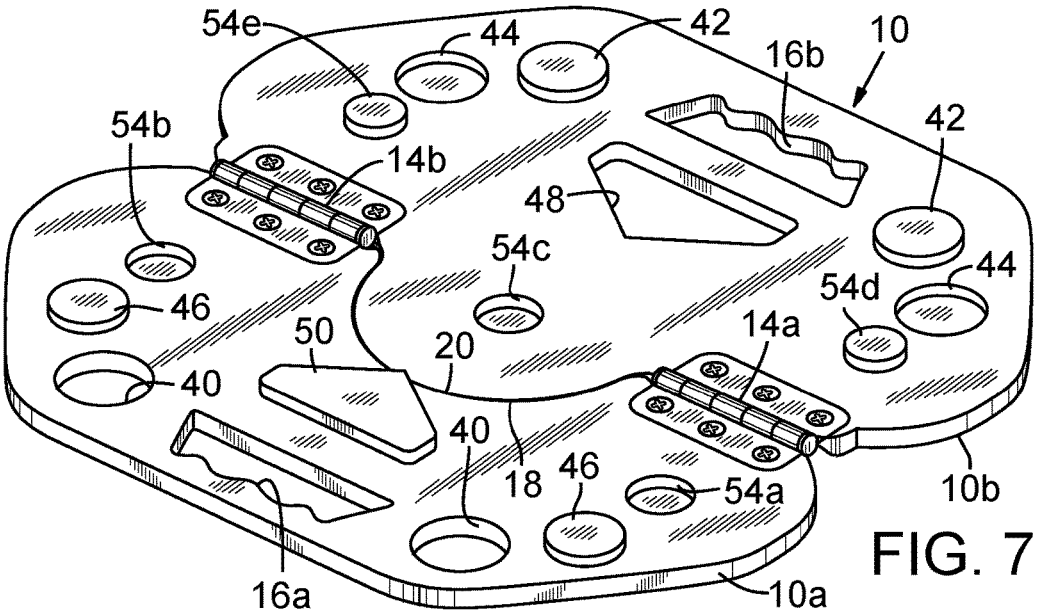
FIG. 7 is a perspective view of the embodiment of FIG. 1 from the underside, with the base halves in their co-planar position.
Figure 8:
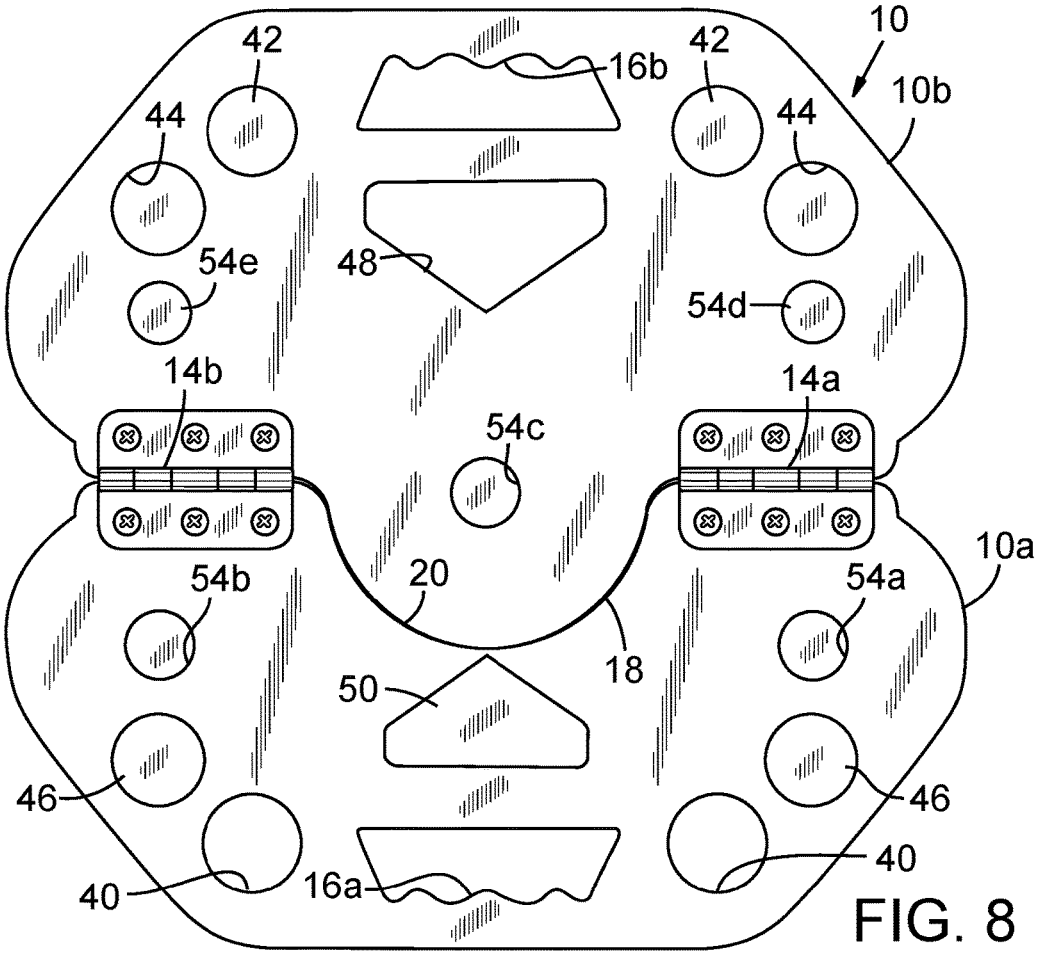
FIG. 8 is a bottom view of the embodiment of FIG. 1 from the underside, with the base halves in their co-planar position.

Base 10 may include holes or depressions and complementing raised portions or bosses so that the entire base will be elevated a small amount to account for the elevation that will result from hinges 14*a* and 14*b*. These holes or depressions and complementing raised portions may also add to the stability of the base halves when the halves are folded against each other, as they engage each other in order to minimize the twisting moment that might otherwise be put on hinges 14*a* and *b*. In the depicted embodiment, two round holes 40 are shown in base half 10*a*, and two complementing raised portions or bosses 42 shown in base half 10*b* (see FIG. 7). Similarly, depressions 44 are shown in base half 10*b* with complementing bosses 46 in base half 10*a*. Depressions 54*a* and *b* are similarly alinged with complementing bosses 54*d* and *e*. A depression at 54*c* may also be provided. The depicted embodiment 10 also includes a hole 48 in base half 10*b* replicating the shape of home plate, with a complementing boss 50 in the underside of base half 10*a*. These depressions, holes and bosses might be entirely deleted or additional holes, depressions and bosses in other shapes and positions might be provided. Additional, smaller holes (not shown) may also be included to permit the base to be spike-driven to further secure its position, but spike anchoring is normally not necessary.

Figure 9:
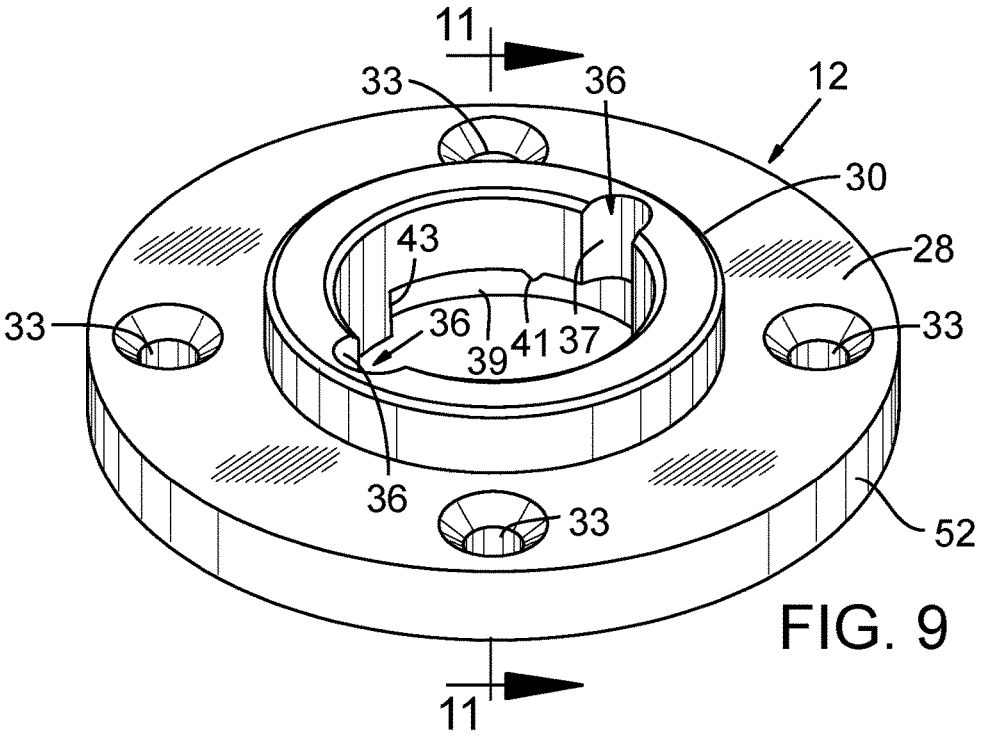
FIG. 9 is a perspective view of the batting tee mount of the embodiment of FIG. 1.
Figure 10:
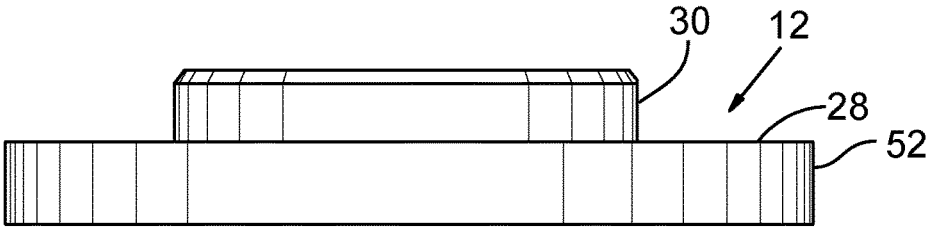
FIG. 10 is a side elevation view of the batting tee mount of FIG. 9.
Figure 11:
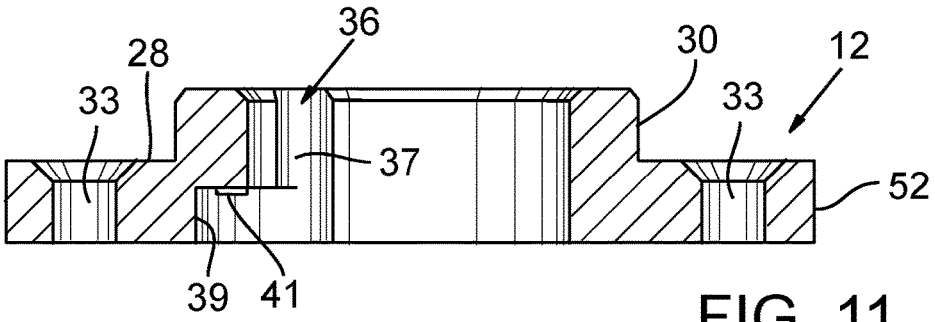
FIG. 11 is a side elevation sectional view taken along lines 11-11 of FIG. 9.

FIGS. 1 and 9-11 best show one form batting tee mounts 12*a-e* may take. Only one of the mounts is shown in FIGS. 9-11 so it has been identified with the numeral 12. Other numerals in FIGS. 9-11 are similarly not shown in the *a-e* series since the mounts are typically of the same construction.

Batting tee mounts 12*a-e* may each be disposed within a circular base support 26*a-e* (See FIG. 1), with the mounts each including a hardened central member 28*a-e* that may be fabricated of metal or other hard material. Each of the central members 28*a-e* may include a raised flange 30*a-e* and is typically mounted to base half 10*a* or 10*b* by mounting bolts such as those shown at 32, which extend through bolt holes 33. Each flange 30*a-e* may include a means for receiving and removably mounting a batting tee, which may be as simple as a threaded arrangement (not shown), with the batting tee and the flange including complementing threads. But more commonly, flange 30*a-e* of each mount 12*a-e* includes a pair of L-shaped slots 36*a-e* to receive complementing nibs 38 disposed at the end of batting tee 22. Slots 36*a-e* are shown best in FIGS. 9 and 11, each of which may have a vertical portion 37 and a horizontally extending annular portion 39. A detent 41 may be included in annular portion 39, as well as a stop 43 in the form of a wall abutment to stop the travel of the nib 38 in annular portion 39. There may also be a spring mechanism (not shown) within each slot to hold the tee with its nibs in place in the slots, but such springs are normally not necessary, so are not depicted.

As mentioned earlier, bosses 52*a-e* on the underside of base 10 may be included to help secure batting tee mounts 12*a-e*. If bosses are included, then complementing holes 54*a-e* may be included so that when base halves 10*a* and 10*b* are folded to the position depicted in FIG. 3, bosses 52*a-e* fit into holes 54*a-e*.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A base for use with a batting tee comprising:

a first base half and a second base half pivotally connected to each other such that the first and second base halves pivot from a first position in which the first and second base halves are co-planar to a second position in which the first and second base halves are flush against one another;

a plurality of tee mounts disposed on said first and second base halves;

wherein one of the first or second base halves includes an extension and the other of the base halves includes a complementing cutout such that when the first and second base halves are in the first position, the extension extends into the cutout;

a pair of spaced hinges mounted along a hinge axis of the first and second base halves such that the first and second base halves are pivotally mounted to each other, wherein one of the plurality of the tee mounts is disposed on the extension such that the hinge axis bisects the tee mount; and a plurality of depressions and complementary bosses are formed on an underside of the first and second base half such that when the first and second base halves are in the second position, the plurality of protrusions and the plurality of the bosses secure the first and second base halves together and when in the first position the plurality of protrusions raise the first and second base halves above a support surface.

2. The base of claim 1, wherein the first and second base halves each include two side edges and the plurality of tee mounts comprise at least five tee mounts, and wherein two of the at least five tee mounts are disposed on each side edge of the first base half and two of the tee mounts are disposed on each side edge of the second base half.

3. The base of claim 1, further comprising a batting tee removably mounted to one of the plurality of tee mounts.

4. The base of claim 3, wherein the batting tee is removably mounted to one of the plurality of tee mounts by a nib and slot arrangement, with a pair of slots in each of the plurality of tee mounts designed to receive two nibs on an end of the batting tee.

5. The base of claim 4, wherein the pair of slots extend circumferentially.

6. The base of claim 1, further comprising an aperture formed at complementing positions forming a hand hole in each of the first and second base halves, such that when the first and second base halves are in the second position, the hand hold is used for carrying the base.

7. A base for a batting tee comprising:

a first base half and a second base half pivotally mounted to each other by a pair of spaced hinges such that the first and second base halves pivot between a first position in which the first and second base halves are co-planar to one another and in a second position in which the first and second base halves are flush against one another;

wherein one of the first or second base halves includes an extension and the other of the base halves includes a complementing cutout, such that when the first and second base halves are in the first position, the extension extends into the cutout;

a tee mount disposed on said extension;

a plurality of depressions and complementary bosses are formed on an underside of the first and second base half such that when the first and second base halves are in the second position, the plurality of protrusions and the plurality of the bosses secure the first and second base halves together and when in the first position the plurality of protrusions raise the first and second base halves above a support surface; and a batting tee removably mounted to the tee mount.

8. The base of claim 7, wherein the batting tee is removably mounted to the tee mount by a nib and slot arrangement, with at least one circumferentially extending slot into which a nib extends.

* * * * *